US005275746A

United States Patent [19]

Kapuscinski et al.

[11] Patent Number: 5,275,746

[45] **Date of Patent: * Jan. 4, 1994**

[54] MULTIFUNCTIONAL VISCOSITY INDEX IMPROVER CONTAINING PHENOTHIAZINE

[75] Inventors: Maria M. Kapuscinski, Carmel; Benjamin J. Kaufman, Hopewell Junction; Theodore E. Nalesnik, Wappingers Falls; Robert T. Biggs, Walden, all of N.Y.

[73] Assignee: Texaco Inc., White Plains, N.Y.

[ * ] Notice: The portion of the term of this patent subsequent to Apr. 6, 2010 has been disclaimed.

[21] Appl. No.: 571,815

[22] Filed: Aug. 24, 1990

[51] Int. Cl.[5] ..... C10M 151/00

[52] U.S. Cl. ..... 252/47.5; 252/51.5 A; 525/301; 525/331.7; 525/349

[58] Field of Search ..... 525/331.7, 349, 301; 252/47.5, 51.5

[56] References Cited

U.S. PATENT DOCUMENTS

| | | | |
|---|---|---|---|
| 3,716,602 | 2/1973 | Iwami et al. | 525/349 |
| 3,842,010 | 10/1974 | Pappas et al. | 525/331.7 |
| 4,160,739 | 7/1979 | Stambaugh et al. | 525/301 |
| 4,816,172 | 3/1989 | Kapuscinski et al. | 252/47.5 |
| 4,820,776 | 4/1989 | Kapuscinski et al. | 525/331.7 |
| 4,952,637 | 8/1990 | Kapuscinski et al. | 525/331.7 |

*Primary Examiner*—Ellen M. McAvoy

*Attorney, Agent, or Firm*—James J. O'Loughlin; Vincent A. Mallare

[57] ABSTRACT

Multifunctional viscosity index improvers for lubricating oils containing an EPM or EPDM polymer onto which has been grafted with an unsaturated reactive monomer and thereafter reacted with amino alkylphenothiazine.

8 Claims, No Drawings

MULTIFUNCTIONAL VISCOSITY INDEX IMPROVER CONTAINING PHENOTHIAZINE

BACKGROUND OF THE INVENTION

This invention relates to a novel multi-functional lubricant additive which is a dispersant, anti-oxidant and a VI improver additive when employed in a lubricating oil composition.

It is well known to those skilled in the art, that hydrocarbon lubricating oils must be formulated by addition of various additives to improve their properties.

In the case of lubricating oils, typified by those employed in railway, automotive, aircraft, marine etc., service, it is found that they become degraded during use due inter alia to formation of sludge which may be generated by deterioration of the oil or by introduction of undesirable components from other sources including the fuel or the combustion air. In order to maintain and improve the properties of the lubricating oil, various additives have heretofore been provided; and these have been intended to improve the viscosity index, dispersancy, oxidative stability, antiwear properties, etc.

It is, therefore, an object of this invention to provide an additive system which imparts to lubricating oils these improved properties of viscosity index, dispersancy antiwear properties and oxidative stability. Other objects will be apparent to those skilled in the art.

DISCLOSURE STATEMENT

The art contains many teachings on the use of polymer additives in lubricating oil compositions. Ethylene-propylene copolymers and ethylene-alpha olefin non-conjugated diene terpolymers which have been further derivatized to provide bifunctional properties in lubricating oil compositions illustrate this polymer type of oil additive.

U.S. Pat. No. 3,522,180 discloses a method for the preparation of an ethylene-propylene copolymer substrate effective as a viscosity index improver for lubricating oils.

U.S. Pat. No. 4,089,794 discloses ethylene copolymers derived from ethylene and one of more ($C_3$ to $C_{28}$) alpha olefin solution grafted with an ethylenically-unsaturated carboxylic acid material followed by a reaction with a polyfunctional material reactive with carboxyl groups, such as a polyamine, a polyol, or a hydroxylamine which reaction product is useful as a sludge and varnish control additive in lubricating oils.

U.S. Pat. No. 4,137,185 discloses a stabilized imide graft of an ethylene copolymer additive for lubricants.

U.S. Pat. No. 4,146,489 discloses a graft copolymer where the backbone polymer is an oil-soluble ethylene-propylene copolymer or an ethylene-propylene-diene modified terpolymer with a graph monomer of C-vinylpyridine or N-vinylpyrrolidone to provide a dispersant VI improver for lubricating oils.

U.S. Pat. No. 4,820,776 discloses lubricants and fuel oils of improved properties containing ethylene-propylene copolymer derived with N-vinyl pyrrolidone and phenothiazine.

U.S. Pat. No. 4,320,019 discloses a multipurpose lubricating additive prepared by the reaction of an interpolymer of ethylene and a ($C_3$–$C_8$) alpha-monoolefin with an olefinic carboxylic acid acylating agent to form an acylating reaction intermediate which is then reacted with an amine.

U.S. Pat. No. 4,764,304 discloses a lubricating oil dispersant VI improver composition containing an additive prepared by the reaction of an olefin copolymer and an unsaturated isocyanate to form reactive intermediate which is then reacted with heterocyclic amines.

U.S. Pat. No. 4,340,689 discloses a process for grafting a functional organic group onto an ethylene copolymer or an ethylene-propylene-diene terpolymer.

U.S. Pat. No. 4,357,250 discloses a reaction product of a copolymer and an olefin carboxylic acid via the "ene" reaction followed by a reaction with a monoamine-polyamine mixture.

U.S. Pat. No. 4,382,007 discloses a dispersant - VI improver prepared by reacting a polyamine-derived dispersant with an oxidized ethylene-propylene polymer or an ethylene-propylene diene terpolymer.

U.S. Pat. No. 4,144,181 discloses polymer additives for fuels and lubricants comprising a grafted ethylene copolymer reacted with a polyamine, polyol or hydroxylamine and finally reacted with an alkaryl sulfonic acid.

The disclosures in the forgoing patents which relate to VI improvers and dispersants for lubricating oils, namely U.S. Pat. Nos. 3,522,180, 4,026,809, 4,089,794, 4,137,185, 4,144,181, 4,146,489, 4,320,019, 4,340,689, 4,357,250, and 4,382,007 are incorporated herein by reference.

An object of this invention is to provide a novel derivatized polymer composition which imparts viscosity index improving, dispersant, antiwear and antioxidant activity to lubricating oil compositions.

Another object is to provide a process for preparing a derivatized copolymer with graft functional monomers to form a reactive intermediate which is then reacted with an amine substituted phenothiazine to yield a modified copolymer which performs as a viscosity index improver, dispersant, antiwear agent and antioxidant in lubricating oil.

Still another object of this invention is to provide a multi-functional lubricant additive effective for imparting viscosity index, dispersant, antiwear and anti-oxidant properties to a lubricating oil composition.

SUMMARY OF THE INVENTION

The present invention is directed to a method of making multifunctional VI improvers based on a polymer prepared by grafting olefin copolymers being a polymer base with monomer containing reactive groups such as anhydride, epoxide, isocyanate or azlactone, then post-reacted with amine substituted phenothiazine.

The multifunctional VI improvers are made in a two-step process. First, an unsaturated monomer is grafted onto polymer under elevated temperatures with addition of a free radical initiator. The grafting reaction is followed by reaction with amine. The following reactions illustrate the process of invention:

1. Grafting reaction (I)

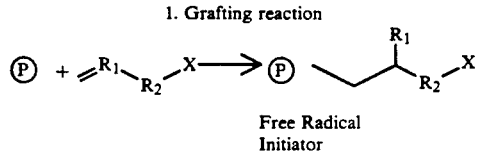

wherein P is a polymer selected from the group consisting of ethylene propylene copolymer, ethylene propylene diene terpolymer, hydrogenated styrene-butadiene copolymer, styrene hydrogenated isoprene or butadiene copolymer, and hydrogenated isoprene polymer; $R_1$ is a hydrogen or an organic linear, cyclic or heterocyclic, and aromatic or heteroromatic group composed of hydrocarbon and/or one or more atom of oxygen, nitrogen, sulfur or phosphorus; and $R_2$ is an organic linear, cyclic or heterocyclic, and aromatic or heteroromatic unit composed of hydrocarbon and/or one or more atom of oxygen, nitrogen, isocyanate, azlactone chloride, ketone aldehyde group or ester group.

2. Capping reaction

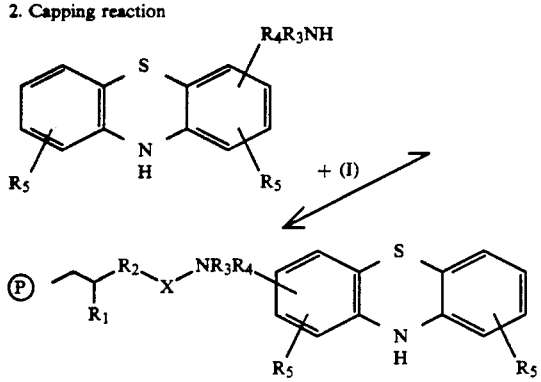

where: $R_3$ is H or $R_2$ $R_4$ is $R_2$ $R_5$ is $R_1$

X' is a unit derived from X

The novel reaction product of the invention preferably is prepared using ethylene-propylene copolymer (EPM) or ethylene-propylene diene terpolymer (EPDM) as a polymer base, maleic anhydride as a functionalizing agent and aminoalkyl phenothiazine as amine substituted phenothiazine.

The lubricant additive of the present invention comprises an oil of lubricating viscosity and an effective amount of the novel reaction product. The lubricating oil will be characterized by having viscosity index improver, dispersancy, antiwear and antioxidant properties. The methods of preparation are also contemplated.

DESCRIPTION OF THE INVENTION

This invention as discussed briefly above, is directed to a polymer comprising an oil-soluble, substantially linear, carbon-carbon backbone polymer bearing functional and units thereon, derived from an unsaturated monomer containing reactive groups such as maleic anhydride, glycidyl methacrylate, isocyanatoethyl methacrylate or vinyl azlactone and amine substituted phenothiazine.

The charge polymer which may be employed in the practice of the present process of this invention may include an oil-soluble, substantially linear, carbon-carbon backbone polymer. Typical carbon-carbon backbone polymers, prepared from monomers bearing an ethylenically unsaturated polymerizable double bond, which may be employed include homopolymers or copolymers prepared from a monomer containing the grouping $$\underset{\underset{A}{|}}{C{=}C} \text{ including } C{=}C{-}R''{-}C{=}C$$

wherein A may be a hydrogen, hydrocarbon such as alkyl, aryl (particularly phenyl) etc., —OOCR typified by acetate or less preferred acyloxy (typified by —OOCR), halide, epoxy etc. R'' may be divalent hydrocarbon typified alkylene, alkarylene, cycloalkylene, arylene, etc.

The polymer or copolymer substrate employed in the novel additive of the invention may be prepared from ethylene and propylene or it may be prepared from ethylene and a higher olefin within the range of $C_3$ to $C_{10}$ alpha-monoolefins. The polymer or copolymer substrate may be also prepared from isoprene, styrene or butadiene.

More complex polymer substrates often designated as interpolymers may be prepared using a third component. The third component generally used to prepare an interpolymer substrate is a polyene monomer selected from non-conjugated dienes and trienes. The non-conjugated diene component is one having from 5 to 14 carbon atoms in the chain. Preferably, the diene monomer is characterized by the presence of a vinyl group in its structure and can include cyclic and bicyclo compounds. Representative dienes include 1,4-hexadiene, 1,4cyclohexadiene, dicyclopentadiene, 5-ethylidene-2-norbornene, vinylnorbornene, 5-methylene-2-norborene, 1,5-heptadiene, and 1,6-octadiene. A mixture of more than one diene can be used in the preparation of the interpolymer. A preferred non-conjugated diene for preparing a terpolymer or interpolymer substrate is 5-ethylidene-2-norbornene.

The polymer and copolymers prepared from the above mentioned monomers having short and long branches or star shape structure may also be employed.

The preferred carbon-carbon backbone polymers include those selected from the group consisting of ethylene-propylene copolymers (EPM or EPR) and ethylene-propylene-diene terpolymers (EPDM or EPT).

When the charge polymer is an ethylene-propylene copolymer (EPM), it may be formed by copolymerization of ethylene and propylene under known conditions preferably Ziegler-Natta reaction conditions. The preferred EPM copolymers contain units derived from the ethylene in amount of 40–90 mole %, preferably 55–80 mole %, say 59 mole %, the remainder being derived from propylene.

The molecular weight $\overline{M}_n$ of the EPM copolymers which may be employed may be about 5,000 to about 1,000,000, preferably about 20,000 to about 200,000, and most preferably about 140,000. The molecular weight distribution may be characterized by $\overline{M}_w/\overline{M}_n$ of less than about 15, preferably 1.2–10, say 1.8.

Illustrative EPM copolymers which may be employed in practice of the process of this invention may be those set forth below in Table I, the first listed being preferred.

TABLE I

A. The EPM marketed by Copolymer Rubber and Chemical Corporation containing 59 mole % of units derived from ethylene and 41 mole % of units derived from propylene, having a molecular weight $\overline{M}_w$ of 140,000 and a $\overline{M}_w/\overline{M}_n$ of 1.6

B. The Epcar 505 brand of EPM marketed by B. F. Goodrich Co., containing 50 mole % of units derived from ethylene and 50 mole % of units derived from propylene, having a $\overline{M}_n$ of 25,000 and a polydispersity index of 2.5.

C. The Esprene brand of EPR marketed by Sumitomo Chemical Co., containing 55 mole % of units derived from ethylene and 45 mole % of units derived from propylene and having a $\overline{M}_n$ of 25,000 and polydispersity index of 2.5.

When the charge polymer is ethylene-propylene-diene terpolymer (EPT or EPDM), it may be formed by copolymerization of ethylene, propylene, and diene monomers. The diene monomer is commonly a non-conjugated diene typified by dicyclopentadiene; 1,4-hexadiene; ethylidene norbornene or vinyl norbornene. Polymerization is effected under known conditions generally comparable to those employed in preparing the EPM products. The preferred terpolymers contain units derived from ethylene in amount of 40–90 mole %, preferably 50–65 mole %, say 59 mole % and units derived from propylene in an amount of 20–60 mole%, preferably 30–50 mole %, say 41 mole % and units derived from diene third monomer in amount of 0.2–15 mole %, preferably 0.3–3 mole %, say 0.5 mole %. The molecular weight $\overline{M}_n$ of the terpolymers may typically be about 5,000 to about 500,000, preferably about 20,000 to about 200,000, and most preferably about 80,000. Molecular weight distribution of the useful polymers is preferably narrow viz a of $\overline{M}_w/\overline{M}_n$ of typically less than 10, preferably 1.5–5, say about 2.2.

Illustrative EPT (EPDM) terpolymers which may be employed in the practice of the present process may be those set forth below in Table II, the first listed being preferred.

TABLE II

A. The sheared Epsyn 4106 brand of EPT marketed by Copolymer Rubber and Chemical Corp., containing 59 mole % of units derived from ethylene, 40.5 mole % of units derived from propylene, and 0.5 mole % of units derived from ethylidene norbornene and having a $\overline{M}_w/\overline{M}_n$ of 2.2 and a molecular weight $\overline{M}_n$ of 80,000.

B. The Ortholeum 5655 brand of EPT marketed by DuPont containing 62 mole % of units derived from ethylene, 36 mole % of units derived from propylene, and 2 mole % of units derived from 1,4-hexadiene and having a $\overline{M}_n$ of 75,000 and a polydispersity index $\overline{M}_w/\overline{M}_n$ of 2.

C. The Ortholeum 2052 brand of EPT marketed by DuPont containing 62 mole % of units derived from ethylene, 36 mole % of units derived from propylene, and 2 mole % of units derived from 1,4-hexadiene and having a $\overline{M}_n$ of 35,000 and a polydispersity index $\overline{M}_w/\overline{M}_n$ of 2.

D. The Royalene brand of EPT marketed by Uniroyal containing 62 mole % of units derived from ethylene, 37 mole % of units derived from propylene, and 3 mole % of units derived from dicyclopentadiene and having a $\overline{M}_n$ of 100,000 and a polydispersity index $\overline{M}_w/\overline{M}_n$ of 2.5.

E. The sheared Epsyn 40A brand of EPT marketed by Copolymer Rubber and Chemical Corp., containing 60 mole % of units derived from ethylene, 37 mole % of units derived from propylene, and 3 mole % of units derived from ethylidene norbornene and having a $\overline{M}_n$ of 140,000 and a polydispersity index $\overline{M}_w/\overline{M}_n$ of 2.

It is a feature of the process of this invention that the additive is prepared in two-step process. In the first step a graft reactive monomer is grafted in the presence of a free radical initiator. In the second step, an amine substituted phenothiazine is reacted with the pendant reactive groups of the said polymer.

THE GRAFT FUNCTIONAL MONOMER

It is a feature of the process of this invention that the graft functional monomers which may be employed (within a polymeric configuration) may be characterized by the presence of units containing an ethylenically unsaturated carbon-carbon double bond and anhydride, epoxide, isocyanate aldehyde or azlactone group. Although the graft monomer may contain more than one ethylenically unsaturated carbon-carbon double bond or reactive group in a preferred embodiment it may contain one of each. Graft monomers containing more than one ethylenically unsaturated carbon-carbon double bond are much less preferred because of the high probability of cross-linking during subsequent reaction.

According to the present invention, the following graft functional monomers may be used:

maleic anhydride
glycidyl methacrylate
allyl glycidyl ether
isocyanatoethyl methacrylate
croton aldehyde
vinyl azlactone It is a feature of the process of this invention that the graft functional monomer may be grafted onto carbon-carbon backbone polymers.

THE GRAFTING REACTION

In the practice of the process of this invention, 100 parts of charge EPM or EPT may be added to 100–1000 parts, say 300–60 parts of diluent-solvent. Typical diluent-solvent may be a hydrocarbon solvent such as mineral oil, n-hexane, n-heptane, or tetrahydrofuran. Preferred solvent may be a commercial hexane containing principally hexane isomers or a commercial mineral grafting oil. Reaction mixture may then be heated under nitrogen to reaction conditions of 60° C. -180° C., preferably 150° C.-170° C., say 155° C. When n-hexane or other low boiling solvent is used, reaction is carried out in pressure reactor at 15–300 psig, preferably 180–220 psig, say 200 psig.

A graft monomer, typically glycidyl methacrylate or maleic anhydride is admitted in an amount of about 1–40 parts, preferably 3 to 5 parts. There is also added a free radical initiator in solution in grafting solvent. Typical free radical initiators, may include dicumyl peroxide, di-t-butyl peroxide, benzoyl peroxide, di-isopropyl peroxide, azobisisobutyro-nitrile, etc. The solvent is preferably the same as that in which the EPM or EPT is dissolved. The initiator may be added in amount of 0.2–40 parts, say 2 part in 0.8–120 parts, say 4 parts of solvent. The preferred free radical initiator is a dicumyl peroxide (DICUP).

The reaction is carried out at a temperature at least as high as the decomposition temperature of the initiator, typically 150°-160° C. or higher.

The grafting reaction is typically carried out at graft polymerization conditions of 60° C.-180° C., say 155° C. during which time bonding of the graft reactive monomer onto the base EPM or EPT polymer occurs.

The product graft polymer may be characterized by the presence of pendant reactive groups bonded to the polymer backbone thorough the residue of the graft monomer, the latter being bonded to the polymer backbone through one of the carbon atoms which formed the ethylenically unsaturated double bond.

Typically the graft product polymer may by contain 0.1-20, say 0.4 units derived from graft monomer per 1000 carbon atoms of the charge backbone polymer.

THE AMINE REACTANT

In practice of the present process, the graft polymer bearing pendant reactive groups may be reacted with an amine substituted phenothiazine.

The amine may be characterized by the following formula:

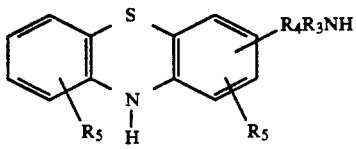

where:

$R_3$ is a hydrogen or an organic radical which may contain linear, cyclic, heterocyclic or heteroaromatic units which may contain one or more atom of oxygen, nitrogen sulfur or phosphorous.

$R_4$ is an organic unit which may contain linear, cyclic, heterocyclic or heteroaromatic units which may contain one or more atom of oxygen, nitrogen, sulfur or phosphorous.

$R_5$ is an organic group which contain lienar, cylcic, heterocyclic or heteroaromatic units which may contain one or more atom of oxygen, nitrogen, sulfur or phosphorous.

The amine which may be employed in this invention is amino alkylphenothiazine.

THE AMIDIZATION REACTION

Amidization may be carried out by adding the graft polymer containing reactive groups to a reaction vessel together with inert-diluent solvent. In the preferred embodiment, reaction may be carried out in the same solvent and in the same reaction medium as that in which the polymer is dissolved.

An amine, typically amino alkyl phenothiazine is added to the reaction vessel. The amount of amine added is preferably 0.1-5 moles, say 1.2 moles per mole of reactive group bonded to the polymer or reactive functinal monomer charged. Typically this may correspond to 0.05-0.5 moles, preferabl 0.008 to 0.18 moles of amine per 100 g of polymer.

The amidization reaction is carried out over 0.1-20 hours, say 4 hours at 60° C.-180° C., say 160° C. with agitation. For ease of handling, the final product may be diluted to form a solution of 4-20 parts, say 13 parts of polymer in 80-95, say 87 parts of mineral oil such as a SUS 100 oil typified by SNO-100. When the product has been prepared in a low-boiling solvent such as hexane, the latter has to be distilled off.

The fluid solution (a lubricating additive) is used for further testing.

It is a feature of this invention that the so prepared polymer solution in oil may find use in lubricating oils as multifunctional additive (e.g. dispersant viscosity index improvers which provide antiwear and anti-oxidant properties, etc) when present in effective amount of about 1.0 to about 20 wt %, preferably 3-15 wt %, preferably about 9 wt %.

Lubricating oils in which the multifunctional additives of this invention may find use may include automotive, aircraft, marine, railway, etc., oils; oils used in spark ignition or compression ignition; summer or winter oils, etc. Typically the lubricating oils may be characterized by a b.p. of about 570° F. to about 660° F., preferably 610° F.; an e.p. of about 750° F. to about 1200° F,, preferably 1020° F.; an API gravity of about 25 to about 31, preferably about 29.

A typical lubricating oil in which the polymer of this invention may be present may be a standard SAE 5W-30 hydrocarbon motor oil formulation having the composition as set forth below in Table IV:

TABLE IV

| | Wt % |
|---|---|
| Base Oil | 82 |
| Viscosity Index Improver (additive of this invention) (10 w % ethylene-propylene copolymer in 90% inert oil) | 9 |
| Standard Additive Package: Polyisobutenyl $(M1290)_n$ succinimide (dispersant); calcium sulfonate (detergent); Zinc dithiophosphate (anti-wear); di-nonyl diphenyl amine (anti-oxidant); 4,4'-methylene-bis (2,6-di-t-butyl phenol) (antioxidant) | 9 |

Use of the additive of this invention makes it possible to readily increase the viscosity index by 25-40 units, say 35 units and to obtain improved ratings on the tests measuring the dispersancy of the system. The viscosity index is determined by ASTM Test D-445.

The present invention comprises making dispersant antiwear and/or antioxidant VI improvers by derivatizing hydrocarbon polymers such as ethylene-propylene copolymer (EPM), or ethylene-propylene-diene terpolymer (EPDM) with, e.g., graft reactive monomer and an amine substituted phenothiazine.

Addition of the above invention additives, to a lubricating oil, may be facilitated by use of a concentrate containing about 1 to about 20 wt. %, preferably about 4 to about 14 wt % of polymer.

The tests and analysis used, according to the present invention, are provided below.

TESTS AND ANALYSIS

1. Oxidation Stability—The antioxidant activity of the new multifunctional VI improver was examined by a proprietary test called Bench Oxidation Test (BOT). In this test, the polymer solution is diluted with SNO-130 oil. The mixture is heated with stirring and air agitation. Samples are withdrawn periodically for analysis, by differential infrared analysis (DIR), to observe changes in the intensity of the carbonyl vibration band at 1710 $cm^{-1}$. Higher carbonyl group intensity indicates a lower thermal oxidative stability of the sample. The result reported, as oxidation index, indicates the change in the intensity of the carbonyl vibration band at 1710 $cm^{-1}$ after 144 hours of oxidation. A lower rating indicates better thermal oxidative stability of the mixture.

2. Dispersancy—The sample is blended into a formulated oil, not containing a dispersant, to form 10.0 wt. % viscosity index improver solution. That blend is tested for dispersancy in the prototype VE Test. In this test, the turbidity of an oil containing an additive is measured after heating the test oil to which has been added a standard blow-by. The result correlates with dispersancy and is compared to three standards (Excellent, Good, and fair) tested simultaneously with the test sample. The numerical rating decreases with an increase in dispersant effectiveness. Results above 100 indicate that the additive does not provide dispersant activity.

Anti-wear Properties

Antiwear performance of a new VI improver were determined by Four-Ball Wear Test (MS-82-79, ASTM D-2266, ASTM4172). The VI improver solutions in formulated oil, having Kinematic Viscosity at 100° C. around 16 cSt were evaluated.

In this test four balls are arranged in an equilateral tetrahedron. The lower three balls are clamped securely in a test cup filled with lubricant and the upper ball held by a chuck which is motor driven causing the upper ball to rotate against the fixed lower balls. Load is applied in an upward direction through a weight/lever arm system. Heaters allow operation at elevated oil temperatures. The test speeds available for each tester are 600 rmp, 1200 rmp and 1800 rpm. Results are reported as average scar diameter (mm).

The amount of reactive graft monomers and amino alkyl phenothiazine incorporated onto OCP in the two-step process is determined by IR-analysis of isolated rubber. The phenothiazine capping reaction yield is determined by aromatic stretch at 1610 $cm^{-1}$. The rubber is isolated from solution by multiple precipitation using cyclohexane as a solvent and acetone as precipitator. The rubber (isolated as a solid) is dried in vacuum at 60° C. for 36 hours.

DESCRIPTION OF THE PREFERRED EMBODIMENTS

The practice of the process of this invention will be more apparent to those skilled in the art from the following examples wherein, as elsewhere in this specification, all parts are parts by weight unless otherwise set forth. Control examples are designated by an asterisk.

EXAMPLE 1

EPM containing about 0.01 moles at succinic anhydride groups (EPSA) per 100 g of polymer which was prepared at Copolymer Rubber and Chemical Corporation via free radical grafting reaction is used. 100 g of this rubber containing reactive pendant anhydride groups is dissolved in 400 parts of mineral SNO-100 oil by heating with mixing at 155° F. for 3 hours under nitrogen blanket.

2.5 wt parts of amino alkyl phenothiazine (PTZ-R-NH2), prepared at Uniroyal, dissolved in 13 wt. parts of polypropylene glycol (Texox 400) is charged. The mixture is heated with stirring under nitrogen for 4 hours.

Then, the solvent neutral oil (SNO-100) is added to give a solution containing 13.0 wt % polymer. This solution is used for further testing.

EXAMPLE 2

100 w. parts of EPM dissolved in 400 parts of mineral grafting oil (SN-130) is heated to 155° C. (with stirring under nitrogen). 4.0 w. parts of glycidyl methacrylate (GMA) is added followed by 1.33 wt. parts dicumyl peroxide dissolved in 6 wt. parts of oil. The mixture is stirred using above conditions for 2 hours.

6.00 wt parts of PTZ-R-NH2 dissolved in 25 wt parts of TEXOX 400 is charged. The mixture is heated with stirring under nitrogen for 2 hours.

Then, the solvent neutral oil (SNO-100) is added to give a solution containing 13.0 wt % polymer. This solution is used for further testing.

EXAMPLE 3

100 wt parts of EPM dissolved in 400 parts of mineral grafting oil (SN-130) is heated to 155° C. (with stirring under nitrogen). 4.0 wt parts of isocyanato ethyl methacrylate is added followed by 1.33 wt parts dicumyl peroxide dissolved in 6.0 wt parts of oil. The mixture is stirred using above conditions for 2 hours.

5.7 wt parts of PTZ-R-NH2 dissolved in 25 wt parts of TEXOX 400 is charged. The mixture is heated with stirring under nitrogen for 2 hours.

Then, the solvent neutral oil (SNO)-100) is added to give a solution containing 13.0 wt % polymer. This solution is used for further testing.

EXAMPLE 4

100 wt parts of EPM dissolved in 400 parts of mineral grafting oil (SN-130) is heated to 155° C. (with stirring under nitrogen). 6.0 wt parts of vinyl azlactone (2-vinyl-4,4- dimethyl-2-oxazoline-5- one) is added followed by 2.1 wt parts dicumyl peroxide dissolved in 6.0 wt parts of oil. The mixture is stirred using above conditions for 2 hours.

10.5 wt parts of PTZ-R-NH2 dissolved in 60 wt parts of Texox 400 is charged. The mixture is heated with stirring under nitrogen for 2 hours.

Then, the solvent neutral oil (SNO-?) is added to giver a solution containing 13.0 wt % polymer. This solution is used for further testing.

EXAMPLE 5*

In this example, 13.0 wt % EPDM solution in mineral oil is prepared. 100 wt parts of EPM which is used in the example 1, is added to 400 wt parts of SN-130 and 300 wt parts of SNO-100. The mixture is heated to 155° C. with stirring and under nitrogen for 3 hours until the rubber is completely dissolved.

RESULTS

The evaluaiton data for the samples of Examples 1, 2, 3,4 and 5* are listed in Tables 1 and 2. The sample numbers are related to the example numbers.

As seen in the Table 1 samples of Examples 1, 2, 3 and 4 containing rubber with incorporated phenothiazine units show good dispersant and antioxidant activity. Samples of examples 2 and 4 show also excellent antiwear performance. The reference sample of example 5* containing unmodified rubber does not show any dispersant, antiwear or antioxidant properties.

The above data indicate that EPM or EPDM copolymers modified by incorporating amine substituted phenothiazine via reacting with reactive pendant groups derived from unsaturated monomers such as maleic anhydride, glycidyl methacrylate, isocyanato ethyl methacrylate or vinyl azlactone form multifunctional VI improvers exhibiting dispersant, antiwear and antioxidant performance in motor oils.

The product of invention (Example 1) is evaluate in the Sequence VE Engine Test. The Sequence VE test procedure is designed to evaluate the prosperity of crankcase motor oils to prevent sludge and varnish deposits and engine wear.

The Seq. VE Engine test results are set forth in Table II.

TABLE I

PROPERTIES OF VI IMPROVERS

| SAMPLE | 1 | 2 | 3 | 4 | 5* |
|---|---|---|---|---|---|
| MATERIAL WT PARTS | | | | | |
| EPSA (1) | 100 | — | — | — | — |
| EPM (2) | — | 100 | 100 | 100 | 100 |
| Monomers | | | | | |
| Glycidyl Methacrylate | — | 4.0 | — | — | — |
| Isocyanataoethyl Methacrylate | — | — | 4.0 | — | — |
| Vinyl azlactone | — | — | — | 6.0 | — |
| DICUP | — | 1.3 | 1.3 | 2.1 | — |
| Amine substituted phenothiazine | 2.5 | 6.0 | 5.7 | 10.5 | — |
| Texox 400 | 13.0 | 25 | 25 | 60.0 | — |
| Grafting Oil | 321.5 | 321.5 | 321.5 | 321.5 | 321.5 |
| Diluent Oil | 332.2 | 312.4 | 312.7 | 269.1 | 347.7 |
| OXIDATION INDEX (3) | 13.3 | 3.1 | 3.2 | 3.5 | 24.0 |
| ANTIWEAR PROPERTIES (4) Avg. Scar Diameter · mm | 1.6 | 0.56 | 1.55 | .36 | 1.7 |
| BENCH DISPERSANCY (BVET Test) | | | | | |
| RESULT | 37 | 65 | 72 | 55 | 200 |
| Standards | 35/65/93 | | 35/68/108 | | |

(1) Ethylene proplyene copolymer containing 0.01 mole of succinic anhydride groups per 100 g of polymer.

(2) Ethylene proplyene copolymer containing 0.5 mole % of ethylidene norbornene.

(3) Change in the intensity of the carbonyl group IR vibration at 1710 $cm^{-1}$ after 144 hours in Bench Oxidation Test.

(4) Four Ball Wear test. Conditions: 1800 rmp, 40 kg, 200 F, 2 hrs.

TABLE II

SEQUENCE V-E- ENGINE TEST COMPARISONS

| VI IMPROVER | RUN 1 | RUN 2 | RUN 3 | RUN 4 |
|---|---|---|---|---|
| Dispersant Inhibitor Pkg. | | A | | |
| Example 1 | 9.50 | | | |
| Competing VI Improver A | | 8.00 | | |
| Competing VI Improver B | | | 9.10 | |
| Dispersant-Olefin Copolymer VI Improver | | | | 8.00 |

| SEQUENCE V-E | | | | | SG LIMITS |
|---|---|---|---|---|---|
| R/A Sludge | 9.5 | 4.1 | 8.9 | 5.8 | 7.0 MIN |
| Avg Sludge | 9.6 | 4.2 | 7.1 | 6.4 | 9.0 MIN |
| PSV | 7.1 | 7.3 | 7.2 | 7.0 | 6.5 MIN |
| AVG Varnish | 6.6 | 6.1 | 6.4 | 5.2 | 5.0 MIN |
| Oil Ring Clogging, % | 0 | 23.8 | 0 | 35 | 15.0 MIN |
| Oil Screen Clogging, % | 0 | 100 | 90 | 78 | 20.0 Max |
| Oil Screen Clogging, % (other than sludge) | 0 | 3 | 5 | 22 | — |
| Cam Wear, mils, Max. | 18.8 | 20.0 | 12.3 | 19.2 | 15.0 |
| AVG. | 6.1 | 7.7 | 8.9 | 4.8 | 5.0 |

In Run 1, Example 1 of the invention gave an excellent Seqeunce V-E Engine Test performance and was substantially better than commercial and competitive viscosity index improvers.

The motor oil composition of the invention containing the novel dispersant and antioxidant VI improver exhibited outstanding properties, as evidenced in the foregoing tests.

We claim:

1. A substantially linear graft polymer with pendant groups containing phenothiazine which are attached thereon in a two-step process comprising in the first step grafting onto said polymer an unsaturated monomer containing reactive groups, in the presence of a free radical initiator at a temperature of at least as high as the decomposition temperature of the initiator in a hydrocarbon solvent as a reaction medium to produce a polymer containing 0.01 to 3.0 moles of said reactive groups per 1000 carbon atoms of the polymer backbone; and in the second step capping an amine substituted phenothiazine with the reactive groups of the polymer at a temperature 100°-200° C. in said hydrocarbon solvent.

2. The graft polymer as claimed in claim 1 where said graft reactive monomer is an unsaturated compound containing a epoxide, anhydride, isocyanate, azlactone or aldehyde group.

3. The graft polymer as claimed in claim 2 where said graft reactive monomer is selected from the group consisting of maleic anhydride, glycidyl methacrylate, allyl glycidyl ether, isocyanatoethyl methacrylate, vinyl azlactone and croton aldehyde.

4. The substantially linear graft polymer containing a carbon-carbon backbone of claim 1 wherein said amine substituted phenothiazine is amino alkylphenothiazine.

5. The substantially linear graft polymer containing a carbon-carbon backbone of claim 1 wherein said backbone polymer is a copolymer of ethylene-propylene or an ethylene-propylene-diene terpolymer.

6. A lubricating oil additive comprising a major portion of lubricating oil and a minor effective viscosity index improving portion of the substantially linear graft polymer containing a substantially linear carbon-carbon backbone polymer of claim 1.

7. The lubricating oil additive of claim 6 which is used in motor oils to improve its viscosity index and antiwear and/or dispersant and oxidation stability properties.

8. The lubricating oil additive of claim 6 wherein said oil contains 0.1 to 5 wt. % of a polymer therein.

* * * * *